United States Patent [19]

Doggett et al.

[11] 4,453,278

[45] Jun. 12, 1984

[54] CHEMICAL DISPENSER

[75] Inventors: Roger H. Doggett, Natick; Edward S. Shanley, Winchester, both of Mass.

[73] Assignee: Knomark, Inc., Jamaica, N.Y.

[21] Appl. No.: 456,109

[22] Filed: Jan. 6, 1983

[51] Int. Cl.[3] ..... E03D 9/02

[52] U.S. Cl. ..... 4/228; 4/227; 4/222

[58] Field of Search ..... 4/228, 227, 222; 222/189, 190

[56] References Cited

U.S. PATENT DOCUMENTS 1,175,032 3/1916 Williams ..... 4/228

4,375,109 3/1983 Jones ..... 4/227

FOREIGN PATENT DOCUMENTS 0011469 of 1891 United Kingdom ..... 4/228

*Primary Examiner*—Henry K. Artis

*Attorney, Agent, or Firm*—Amster, Rothstein & Engelberg

[57] ABSTRACT

A novel chemical dispenser for dispensing a predetermined volume of a chemical solution into a body of liquid, such as water in a toilet tank, in response to a change in the level of the liquid comprises a container which holds the solid chemicals to be dispensed, an air vent extending from the top of the container, and a siphon which enters the container through a deck located below the top of the container and has a U-shaped bend extending above the top of the container but below the top of the air vent. The dispenser structure provides substantial isolation of the chemical solution in the dispenser from the surrounding tank water between flushes without the presence of any isolating air bubbles and also provides a color change signal indicating when the solid chemical within the dispenser is depleted.

21 Claims, 4 Drawing Figures

CHEMICAL DISPENSER

This invention pertains to an improved method and apparatus for dispensing chemical solutions. More particularly, the present invention is directed to an improved method and apparatus for cleansing and disinfecting a flushing toilet, comprising a toilet tank and bowl, by separately dispensing cleansing and disinfecting solutions into the toilet tank during each flush cycle.

There are a wide variety of dispensers for adding chemicals to a flushing toilet which are either described in the patent literature and/or are commercially available. Various purposes are served by such dispensers. For example, surfactants may be dispensed to help keep the toilet bowl clean. Perfumes and colorants may be dispensed to provide pleasing odor and color. Strong oxidants such as hypochlorites may be dispensed to discourage microbiological growth and to inhibit staining of the toilet bowl.

U.S. Pat. Nos. 4,216,027; 4,208,747; 4,200,606 and 4,248,827 are several of a larger group of patents all of which are assigned to Procter & Gamble Company and relate to various aspects of a chemical dispenser for toilet tank use, one form of which is being sold by Procter & Gamble under the trademark "Brigade". The Brigade dispenser is designed to simultaneously dispense controlled amounts of surfactant, disinfectant, dye and perfume to a flushing toilet bowl during each flush cycle. The surfactant and disinfectant compositions and the solutions formed therefrom are disposed in separate dispenser compartments which are kept isolated from each other and from the surrounding tank water in the period between each flush so as to prevent premature mixing of these incompatible chemicals which would reduce or eliminate their effectiveness in cleansing and disinfecting a toilet bowl at the time of flushing. Isolation is accomplished by providing each dispenser with an air trap structure which causes an air bubble to form and remain disposed between the solution formed in each dispenser and the surrounding tank water. A similar air bubble may be formed on the air vent side of each dispenser compartment, or, alternatively, the dispenser may be designed in such a fashion that the air vent remains above the water line when the dispenser is disposed in a toilet tank.

The Procter & Gamble Brigade dispenser is alleged to be an improvement over the dual dispenser concept disclosed in Radley U.S. Pat. No. 3,504,384 in that the individual dispenser compartments of Radley do not provide any means for separating the bleach and surfactant solutions formed in each dispenser compartment from the surrounding tank water. The prior art does include a number of dispenser designs which provide substantial isolation between the solution formed in the dispenser and the surrounding tank water, including Williams U.S. Pat. No. 650,161; Williams U.S. Pat. No. 1,175,032; Hronas U.S. Pat. No. 3,339,801, and a number of other patents which are cited in the aforementioned Procter & Gamble patents or are otherwise known in the art. These patents have been distinguished by Procter & Gamble on the ground that they either do not provide the same degree of isolation as the dispenser structure of Dirksing U.S. Pat. No. 4,208,747, or that isolation is achieved as a result of some means other than the formation of an air bubble which physically separates the solution formed in the dispenser from the surrounding tank water.

The dispensers in the aforementioned Williams patents are true siphons in which tank water flows into the dispenser as the water level rises above the bend in the siphon pipe and, as the tank water level falls, the dispenser discharges that part of its liquid contents which is in contact with the inner leg of the siphon tube. While the structure of Williams is less complicated than the air trap structure of the Brigade dispenser, it does not result in the formation of an air bubble or provide any other means of physical separation between the solution formed in the dispenser and the surrounding tank water. Moreover, because of the internal location of the siphon tube in the Williams dispenser, it is not directly amenable to the low cost vacuum thermoforming production technique which is used to produce the Brigade dispenser.

It is an object of this invention to provide a chemical dispenser which operates on the siphon principle of the Williams patents and is capable of preventing significant leakage of the solution formed in the dispenser into the surrounding tank water without the use of air traps, the formation of air bubbles or other means of physical isolation.

It is another object of this invention to provide a novel chemical dispenser capable of providing a color signal that the chemicals in the dispenser are exhausted and, accordingly, of the need to replace the dispenser.

The present invention is based on the discovery of a chemical dispenser in which the siphon is so constructed and located with respect to (a) the container which holds the solid chemicals and chemical solution to be dispensed, and (b) the dispenser air vent, as to provide (1) the release of a predetermined volume of chemical solution in response to a change in the level of the body of liquid in the tank in which the dispenser is disposed, (2) substantial isolation of the chemical solution in the dispenser from the surrounding tank water without the use of moving parts, air traps or air bubbles, (3) controlled mixing of fresh liquid entering the dispenser with the solid chemical and chemical solution disposed in the dispenser, and (4) a color change signal at the point in time when the solid chemical in the dispenser is substantially depleted. More specifically, it has been found that by locating the point where the siphon tube enters the dispenser at a level below the top level of the container, preferably in a deck or shoulder formed in the container for that purpose, and having the U-shaped bend in the siphon tube rise to a location which is above the top level of the container but below the top of an air vent which is also in fluid communication with the container, a predetermined volume of chemical solution can be formed and that solution will remain substantially isolated from the surrounding tank water until it is dispensed when the toilet is flushed. That isolation is achieved without the formation of any air bubble or air trap in the siphon and, indeed, the size and shape of the siphon is selected so that there is plug flow of liquid in the siphon when chemical solution flows out or fresh water from the tank flows into the dispenser. Moreover, by controlling the location and arrangement of the siphon entry port into the dispenser, the amount of mixing between fresh liquid entering the dispenser and the solid chemical (and the solution surrounding it) in the dispenser can be controlled.

As a result of the foregoing structural arrangement, it is possible to rely upon a change in the intensity of the color of the chemical solution emanating from the dispenser as a signal that the solid chemical in the dispenser has been substantially depleted. While not wishing to be limited to any particular theory, it is presently believed that the change in color intensity is related to a change in the viscosity of the dye-containing surfactant solution which occurs at the point in time when the solid cake of material originally placed in the container is depleted. In the dispenser of the invention, the concentration of dye in the solution delivered upon flushing is largely dependent upon the strong downward vertical stream generated by the incoming water as it breaks over the upper bend in the siphon tube and streams into the dispenser under an appreciable fluid head. This stream mixes with a heavy, syrupy layer of dye/surfactant solution which lies above the undissolved cake of the same materials in the bottom of the dispenser container. The heavy, syrupy layer is maintained by slow dissolution of the solid cake. During most of the useful life of the product, the cake is slowly dissolved to maintain a continuous supply of viscous, concentrated color-surfactant solution. This mechanism provides relatively constant color delivery throughout most of the life of the product. As use continues, the solid cake erodes away as it dissolves to form additional viscous solution. Eventually, the solid cake disappears, leaving only viscous solution. This stage in the life of the product coincides with the beginning of strongly colored flushes. It is believed that the viscous solution becomes less viscous as it is attenuated by succeeding incoming increments of fresh water and, for a short time, the improved mixing resulting from lower viscosity leads to stronger color discharge. However, after a relatively short additional period of use, attenuation of the dye concentration becomes the controlling factor and the color rapidly fades to zero.

More specifically, the present invention is directed to a chemical dispenser containing a chemical in a solid form, which dispenser is immersed in a body of liquid, such as a toilet tank, and which dispenses a predetermined volume of chemical solution in response to the level of the body of liquid being lowered from a first elevation to a second elevation in which said dispenser comprises (a) a container holding both a quantity of a chemical in a solid form and a chemical solution formed therefrom; (b) an air vent in fluid communication with the top of the container which extends upwardly and terminates above the uppermost portion of said container; and (c) a siphon in fluid communication with the container for conveying a predetermined volume of a chemical solution from the container into said body of liquid in which said dispenser is immersed in response to the level of said body of liquid being lowered from said first elevation to said second elevation, said siphon commencing at an entry port in the container, which entry port is located below the top of the container, and extending upwardly from said entry port beyond the top of the container but below the top of the air vent and thereafter returning via a U-shaped bend therein to terminate at a point below the entry port. The foregoing siphon delivers a volume of chemical solution to the surrounding tank water which is substantially equal to the volume of the container lying between the entry port of the siphon tube and the lowest point of the air vent in response to a lowering of the body of liquid in the surrounding tank water when the toilet is flushed and delivers substantially that volume of fresh liquid to the container through the siphon when the level of liquid in the surrounding tank water returns to its normal level after the flush cycle is completed. The size and shape of the siphon is selected to ensure plug flow of solution or liquid from the container to the surrounding tank water and vice versa without the formation of air bubbles.

The invention will be further understood from the following more detailed description taken in connection with the accompanying drawings wherein:

FIG. 1. is a schematic drawing of a chemical dispenser constructed in accordance with the invention;

Figure 1:
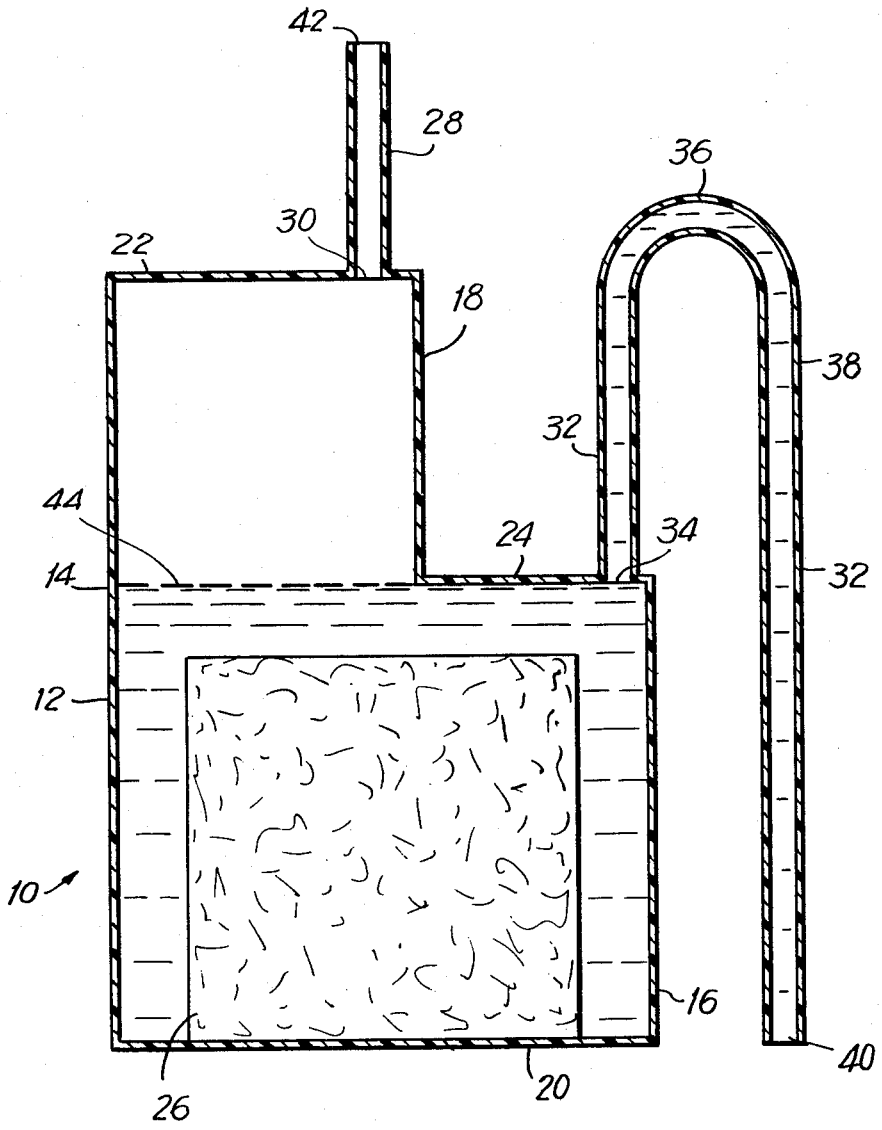

Referring to the drawings, FIG. 1 schematically illustrates the basic structure and operation of a single chemical dispenser 10 constructed in accordance with the invention which is designed to dispense a solution of a surfactant colorant, disinfectant or other desired material. In a preferred embodiment which will be described subsequently herein, a dispenser having dual containers for simultaneously dispensing both surfactant, color and disinfectant compositions is described. The dispenser includes a container 12 defined by side walls 14, 16 and 18, a bottom wall 20, a top wall 22 and a deck or shoulder 24. A solid chemical or mixture of chemicals 26, preferably in cake form, which can be selected from any of the wide variety of materials to be described in detail hereinafter, is housed within said container 12 and rests against bottom wall 20. An air vent 28 in the form of a pipe or tube is in fluid communication with the container 12 through opening 30 in the top wall 22 thereof and extends for some distance beyond the top of the container. Siphon tube 32 is in fluid communication with the container 12 by virtue of an entry port 34 in deck or shoulder 24 of container 12. The siphon tube extends upwardly beyond the top wall 22 of container 12 where it forms a smooth inverted U-bend 36 and then extends downwardly via leg 38 terminating in an opening 40 which is at approximately the same level as the bottom of container 12.

The operation of the dispenser is apparent from FIG. 1. First, to be operative, the dispenser must be disposed in a body of liquid, such as a toilet tank, and the container 12 should be fully immersed therein so that the bend 36 in the siphon tube is beneath the normal high water line of the tank. As the water level in the flush tank rises above the inverted U-bend 36 in the siphon tube, water flows into the container 12 through the opening 40 at the bottom of siphon tube 32 and the siphon tube itself and enters the container 12 with a rush. The directed stream of water which results therefrom is important to the control of mixing between the active solid chemicals and chemical solutions which are formed therefrom and the fresh incoming water and, as will be pointed out hereinafter in connection with the preferred embodiments of the invention, can be controlled. Incoming water will fill the container and also at least that portion of the air vent 28, which is below the highest point 36 of the siphon. The operation of the dispenser will not be adversely affected if the high water level is above the top 42 of air vent 28, although trace amounts of chemical solution formed in the dispenser may thereby flow into the surrounding tank water in the interval between flushes.

When the tank water level falls, as for example, in response to the flushing of a toilet, the dispenser will immediately begin to drain through siphon tube 32, thereby dispensing a portion of the chemical solution which was formed with incoming fresh water during the previous flush cycle. Dispensing of the active chemical ingredient solution will continue only until such time as the level of solution within the container 12 drops below deck 24 and entry/exit port 34 in the deck 24 which is in fluid communication with siphon 32. Accordingly, the volume of active solution delivered to the tank during any flush cycle will be exactly fixed by the volume of the container which is above the deck 24, i.e., the upper chamber of the container defined by the upper walls, side walls, and top wall of the container and dotted line 44 in FIG. 1.

The location of the upper end 42 of air vent tube 28 is critical to the proper operation of the dispenser 10, since the dispenser will not operate properly unless the upper end 42 of the air vent tube 28 is higher than the inverted U-bend 36 in the siphon tube. If the air vent is at the same level as the siphon U-bend or lower, the dispenser may fill through the vent tube, leaving the siphon tube gas-bound and inoperative because of entrapped air bubbles. In addition, the vent tube must be of sufficient diameter to permit air to escape from container 12 through air vent tube 28 at a volumetric rate which is at least about equal to the volumetric rate at which water enters the container through siphon tube 32. By way of example, in a preferred embodiment, a dispenser sized for a conventional toilet tank might have an upper chamber volume in the range of 5 to 100 milliliters and a siphon tube of at least 1/32 inch in cross-sectional width. In such a dispenser, proper filling through the siphon tube would require that the top of the air vent tube 42 extend at least ½ inch, preferably about ¾ inch, above the U-shaped bend in the siphon tube.

The location of the siphon tube 32, and particularly the inverted U-shaped bend 36 in the siphon, in relation to the upper chamber of container 12, is also significant to the proper functioning of the dispenser. Unless the U-shaped bend 36 is above the top wall 22 of container 12, the siphon 32 will facilitate extensive and continuous flow of chemical solution to the surrounding tank water during the period between flushes. Such flow negates the desired metering function of the dispenser and also allows premature mixing when mutually reactive ingredients, such as surfactants, colorants, and disinfectants, are simultaneously dispensed from separate containers of a dual dispenser. The activity of the chemicals is then lost in the tank water rather then being delivered to the toilet bowl in an active form for cleansing, coloring and sanitizing purposes upon flushing.

It has now been discovered that when the inverted U-bend 36 of the siphon 32 is located above the top wall 22 of container 12, the chemical solution within container 12 will not significantly flow into the surrounding tank water but rather will remain substantially isolated therefrom between flushes despite the absence of any valves, air locks, air traps or other devices in the siphon tube. While not wishing to be limited to any particular theory, it is presently believed that the overall structure and relationship between the deck 24, siphon tube 32 and air vent outlet 42, coupled with the fact that the chemical solution has a density greater than water, combine to limit flow of chemical solution to trace amounts even when the dispenser is permitted to stand in tank water for as long as a week between flushes. This result is achieved even in those circumstances where the top of the air vent is immersed below the standing water line in the tank, i.e., in a condition where the only two inlet/outlet ports to the container are in direct fluid contact with the surrounding tank water as a result of the presence of a solid column of water in both the air vent and siphon tube.

Figure 2:
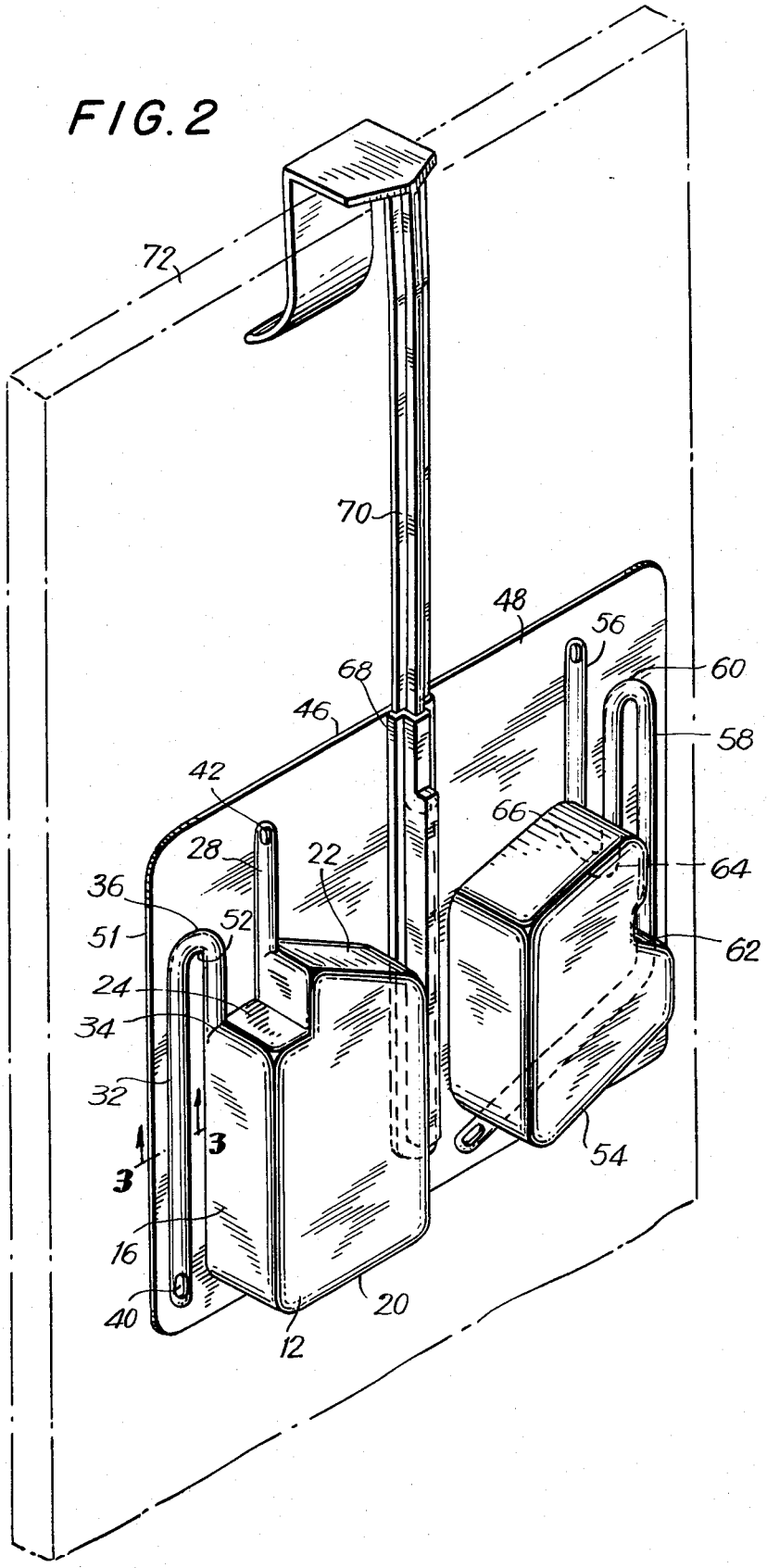
FIG. 2 is a perspective view of a preferred, vacuum-formed, two-compartment dispenser constructed in accordance with the invention.

FIG. 2 is a perspective view of a preferred thermoformed dual dispenser 46 constructed in accordance with the invention. Such a dispenser is vacuum or pressure thermoformed to produce the desired dispenser configuration by disposing a thin sheet of thermoplastic material 48 over a mold cavity having the desired physical configuration of a dispenser and applying heat and vacuum (or pressure) to the plastic sheet so that it conforms to the mold cavity to achieve the desired shape. Thereafter, the desired chemicals are deposited in containers 12 and 54 and a suitable backing member 51 is laminated to thermoformed sheet 48 to complete the dual dispenser structure. The thermoforming technique may employ any thermoplastic film having sufficient strength, rigidity and chemical resistance to maintain its integrity under the conditions of intended use. The techniques for producing such thermoformed products are well known to those persons skilled in the art and do not form a part of the instant invention. Typical materials include polyvinyl chloride, styrene, etc., having a thickness of about 20 mils.

The dispenser on the left-hand side of FIG. 2 is substantially identical in both structure and function to the schematic drawing of FIG. 1 and, accordingly, similar parts have been designated with similar numerals. The overall shape of container 12 does not significantly affect the operation of the dispenser, except to change the volume of the upper chamber of the container 12 and, therefore, the volume of solution which will be discharged during each flush cycle.

The size and cross-sectional shape of the siphon 32 is also highly important, if not critical, to proper operation of the novel chemical dispenser of the invention. This is due, in large part, to the fact that the water level rises quite slowly in a toilet tank when it is being refilled. If the siphon tube is too large in diameter, e.g., ¼ inch or greater, incoming water during the fill cycle will dribble over the lower part 52 of the inverted U-bend 36, rather than filling the entire cross-section of pipe 32 with plug flow. Such a flow condition can result in a failure to displace the air which is normally present in the siphon 32 during a flush cycle. If an air bubble is retained in the siphon 32, as at the inverted U-bend 36, it might cause the tube to become gas bound and thereby prevent proper functioning of the siphon during subsequent flush cycles. The dribble-over effect does not occur in very small diameter siphon tubes, e.g., on the order of 1/16 inch or less in diameter. However, the discharge flow rate is then so slow that the dispenser may fail to discharge completely in the time available during the normal flush cycle.

Figure 3:
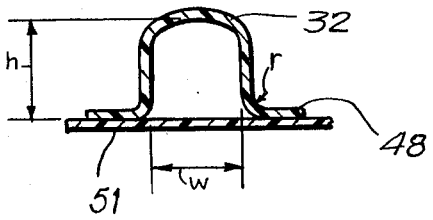
FIG. 3 is an enlarged cross-sectional view of the vacuum-formed siphon tube shown in FIG. 2, taken along section line 3—3 of FIG. 2.

FIG. 3 is a cross section of the siphon 32 taken on the section line 3—3 of FIG. 2 showing the significant dimensions thereof including cross-sectional width w, height h and junction radius r. Ideally, the junction radius r is zero and the junction is a perfect 90°. However, in actual thermoforming practice, that result is rarely achieved since sharp angles cannot be easily formed without the risk of rupturing the thermoplastic film, and the junction radius will normally vary from 0 to ⅛ inch. The cross-sectional width w is extremely important to achieving plug flow in the siphon, and the width is desirably maintained between about 3/16 and ¼ inches. The siphon tube height h is somewhat less critical and the desirable range is about ⅛ to 3/16 inches. It will be understood by those persons skilled in the art that minor modifications from the foregoing dimensions may be tolerated, provided that the overall size and shape of the siphon tube is selected with respect to the flow rate of liquid into and out of the toilet tank so as to permit plug flow throughout the cross section of the siphon tube, thereby substantially eliminating the possibility of forming air bubbles which would interfere with the proper operation of the siphon tube.

The second dispenser, which is depicted on the right-hand side of FIG. 2, is substantially the same in structure and operation as container 12 in that it includes a container 54, an air vent 56 which extends from and is in fluid communication with the top of the container; and a siphon tube 58 having an inverted U-shaped bend 60, said siphon being in fluid communication with the container 54 through an entry port located below the top of the container. It will be readily apparent that the physical locations and relationships between the top of the container, the top of the air vent, and the top of the U-shaped bend in the siphon tube are precisely the same as previously described in connection with container 12 in FIGS. 1 and 2. Container 54 is distinguishable, however, in that it includes baffle wall 62 and a U-shaped siphon entry pipe 64 which communicates with entry port 66 in container 54. This structure is specially designed for use with strong oxidant or disinfectant chemicals such as hypochlorite solutions which have a tendency to release gases. Gas bubbles entrained in the active ingredient solution formed within container 54, which could exhibit a tendency to become entrapped in the siphon tube and interfere with the proper operation of the dispenser, are deflected by the baffle wall and siphon entry design to direct such gas bubbles upwardly through air vent 56. This novel design is the subject of copending, commonly assigned, U.S. patent application Ser. No. 456032, filed in the name of Douglas F. Melville, Jr., on even date herewith and entitled titled "Gas Binding Resistant Chemical Dispenser", the disclosure of said application being hereby incorporated herein by reference.

FIG. 2 also illustrates a thermoformed sheath 68 and hanger 70 which together form the necessary structure for hanging the dual dispenser from the top edge of a toilet tank wall 72. The details of that novel hanger structure are described in copending, commonly assigned, U.S. patent application Ser. No. 455973, filed in the names of Stanley Pilch and Elliott Subervi, on even date herewith and entitled "Improved Hanger for Chemical Dispenser", the disclosure of said application being hereby incorporated herein by reference.

In the preferred embodiment of the dispenser of the invention which is illustrated in FIG. 2, the left-hand container 12 is used to dispense a surfactant, colorant and odorant and the right-hand container 54 is used to dispense a disinfectant material. Any of the numerous materials of the foregoing type, which have been described in the prior art, are useful in the dispenser system of the present invention. Detailed descriptions of potentially suitable materials and formulations may be found, for example, in Kitko U.S. Pat. Nos. 4,200,606; 4,248,827; the prior art described in other parts of this disclosure; and an article by Henning, *Journal of Soap, Perfumery & Cosmetics,* Vol. 50, pp. 426–427 (1977), all of which are incorporated herein by reference. As described in the foregoing prior art, the disinfectant may be any bacteriostatic material, for example, compounds which provide a hypochlorite ion in aqueous solution. For the purpose of this invention, it is preferred to employ the disinfectant compound in a disc or cake form and to utilize that material in the gas-binding resistant container 54. One such material, calcium hypochlorite, is sold under the trademark "HTH" by Olin Chemical Company. Container 12 preferably contains a surfactant and a dye, formulated together in a cake form, along with perfumes, preservatives, or other similar ingredients. The selection of particular surfactants, dyes and other materials is not critical, and any of the known materials described in the prior art can be used. A particularly preferred dye is Direct Blue 86, Color Index No. 74180, which is sold under several trademarks, including Amfast Turquoise 8 GLP Conc. The preferred surfactant is tridecyloxypoly (ethyleneoxy) ethanol which is a biodegradable, nonionic surfactant sold under the trademark "Emulphogene TB-970" by GAF Corporation. A currently preferred formulation for use as a surfactant/dye cake in container 12 is as follows:

Emulphogene TB-970: 90.9–92.9%
Neodol 25-12: 1.0
Lexguard-M: 0.1
Amfast Turquoise 8 GLP-Conc.: 6.0–8.0

Neodol 25-12 is a $C_{12}$–$C_{15}$ ethylene oxide and functions as a detergent and wetting agent. Lexguard-M is the methyl ester of para-hydroxbenzoic acid and is a microbial agent (preservative) used in foods and pharmaceuticals. The size of the cake is not critical and may range up to 60 grams or more depending on the physical volume of the container and the desired length of dispenser life.

Cakes having the foregoing or a similar composition may be formed by melting and mixing the components; casting the mixture into molds of the desired shape; solidifying the cakes by cooling; and stripping the cakes from the molds. Pellets, granules, discs or other solid forms can be formed in lieu of cakes, by known techniques, but are less preferred.

Figure 4:
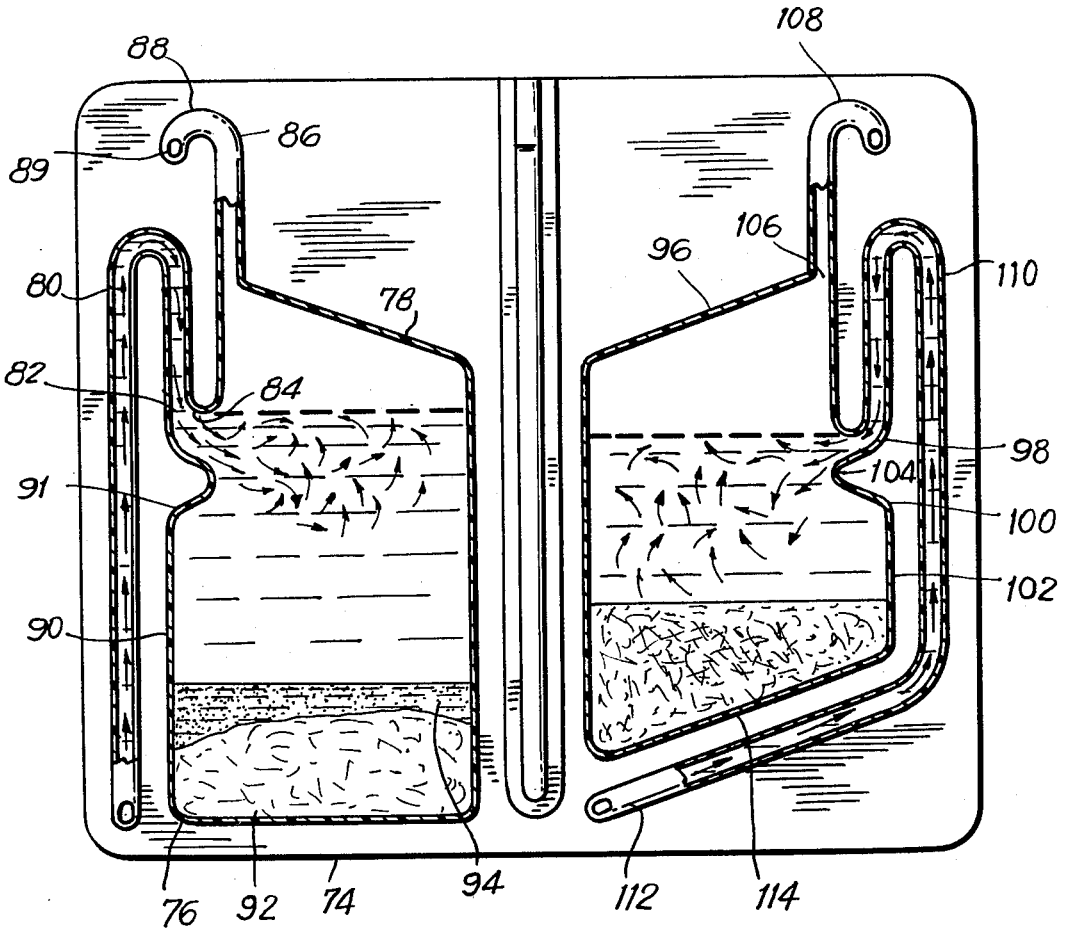
FIG. 4 is a front view of an alternate embodiment of the two compartment dispenser illustrated in FIG. 2.

FIG. 4 illustrates an alternate embodiment of the dispenser shown in FIG. 2 and, in addition, illustrates aspects of the dispenser exhaustion signal concept which is equally applicable to the embodiment of FIG. 2. Referring to the left-hand side of the dual dispenser 74 illustrated in FIG. 4, there is shown a container 76 having a top wall 78; a siphon tube 80; a siphon tube entry port 82 located in a shoulder 84 of the container 76, which is below the top 78 thereof; and an air vent 86. The air vent differs from the embodiment shown in FIG. 2, in that it includes a generally U-shaped bend 88 at its upper end so that the opening 89 in its end faces at least partially downward. That form of air vent is described in Williams U.S. Pat. No. 650,161 as a means of enhancing isolation between the solution formed in the container 76 and the surrounding tank water when the dispenser is completely immersed in water.

It will be readily apparent that the crucial relationship between the top of the container 78, the top of the siphon 80, and the top of the air vent has been maintained as in the previously described embodiments of the invention. In contrast to the container shown in FIG. 2, side wall 90 of the container 76 is provided with an indentation 91 immediately below entry port 82 of the siphon. The effect of this arrangement is to direct the incoming flow of fresh liquid from the tank (illustrated by the arrows in siphon tube 80) in a direction which is substantially parallel to the solid surfactant-/colorant cake 92 and the overlying relatively viscous solution 94 thereof. In contrast, the relationship between siphon 32 and entry port 34 in FIGS. 1 and 2 tends to direct the incoming head of water directly downward in a manner which is substantially perpendicular to the solid chemical cake and overlying solution. Thus, by modifying the direction of the entry port of the container and the shape of the side wall immediately therebelow, it becomes possible to control the degree of mixing between fresh water entering the dispenser and the active chemical ingredients contained therein. Increased mixing caused by a more direct impingement of the incoming liquid stream against the solid chemical will result in a higher rate of solution of active ingredients and a higher concentration of active ingredient in the chemical solution siphoned off during each flush cycle.

The container 96 illustrated on the right-hand side of FIG. 4 is illustrative of the gas-binding resistant dispenser depicted on the right-hand side of FIG. 2 and described earlier herein. In that embodiment, the siphon entry port 98 has a more pronounced U-shape, and the indentation or baffle 100 in side wall 102 extends further into the container so that the point of furthest indentation 104 extends directly below the entrance 106 to air vent 108. The purpose of this arrangement is to assure that the generally vertically rising gas bubbles generated by the aqueous hypochlorite solution continue upward toward and through the air vent 108 and do not enter siphon 110 through entry port 98. Within this functional limitation, the design of entry port 98 and indentation 100 may be modified so as to direct the flow of liquid in a manner which either maximizes or minimizes the amount of mixing between the incoming stream of water and the hypochlorite solution.

Dispenser/container 96 in FIG. 4 also illustrates a modified form of siphon tube 110 having an extension 112 thereof which extends below and substantially parallel to the bottom wall 114 of container 96. The larger volume of liquid in the longer siphon tube will assist in clearing any gas bubbles formed in the siphon. A siphon tube of increased length may be employed with either the surfactant/dye dispenser or the disinfectant dispenser.

The novel dispenser of the invention is capable of giving an advance color signal to the user that surfactant/colorant material is about to be exhausted. This result is believed to occur because of the physical relationship between the location of the solid color cake at the bottom of the dispenser and the controlled mixing pattern made possible by the location of the siphon/discharge tube with respect thereto. It is presently believed that the syrupy, rather dense solution of surfactant/dye 94 which resides immediately above solid cake 92 retains a relatively constant viscosity during normal operation of the dispenser since its dilution by incoming water is roughly offset by the rate at which the solid cake 92 is dissolved. Accordingly, the solution leaving the dispenser during each discharge cycle will have a relatively constant concentration of chemicals and, therefore, a constant color during the bulk of its life cycle. However, when the solid cake has been fully dissolved, the viscous solution 94 will become incrementally less viscous with each addition of water through siphon tube 80. Initially the reduced viscosity will result in improved mixing, and such improved mixing briefly leads to a stronger color concentration in the solution discharged from the dispenser.

The foregoing color signal can be used to establish the amount of disinfectant which should be used in a dual dispenser to ensure that the disinfectant material is not prematurely exhausted. Taking into consideration the normal concentrations of solutions which will be formed within the dispenser of the invention; the average water flow rates in a toilet tank flush cycle; and the color change characteristics described hereinabove, it becomes possible to determine the number of flushes during which a typical dispenser will be functional. For example, a typical dispenser will hold about 45 grams of HTH and 60 grams of a surfactant/dye cake. This quantity of HTH is sufficient to create an average available chlorine level of 5 parts per million in 1534 gallons of water. Similarly, 60 grams of a color cake containing 6% of a blue dyestuff will create a pleasing blue color when dissolved in 1500 gallons of water. The average color strength will be about 0.7 times the strength of a 0.26% aqueous solution of copper sulphate pentahydrate. An average toilet tank delivers about 3 gallons on each flush. Accordingly, the hypochlorite might be expected to last about 510 flushes, while the dye might be expected to last for about 500 flushes. In fact, dispenser delivery is somewhat affected by such factors as the time interval between flushes, the temperature of the flush water, and the loss of available chlorine value in hypochlorite solutions due to slow decomposition during aging.

Table I below shows the performance characteristics of the dual dispenser of the invention under the foregoing circumstances, utilizing a 45 gram HTH tablet, a 60 gram surfactant/dye cake, and an arbitrarily assigned color value of 1.0 to a 0.26% solution of copper sulphate pentahydrate. Color measurements were made by visual comparison in accordance with the standard techniques known in the art.

TABLE I

| Color Cake with 6% Dyestuff Hypochlorite | | | Color Cake with 8% Dyestuff Hypochlorite | | |
|---|---|---|---|---|---|
| Number of Flushes(1) | Strength (PPM)(2) | Color Strength | Number of Flushes | Strength (PPM) | Color Strength |
| 6 | 5.5 | 1 | 6 | 4.3 | 1.25 |
| 98 | 5.2 | 0.3 | 98 | 3.6 | 0.5 |
| 171 | 3.2 | 0.3 | 171 | 3.0 | 0.4 |
| 272 | 3.0 | 0.2 | 272 | 3.0 | 0.3 |
| 348 | 3.7 | 0.3 | 348 | 3.7 | 0.4 |
| 469 | 2.9 | 0.4 | 469 | 2.8 | 0.7 |
| 520 | 2.7 | 1.0 | 520 | 1.7 | 3.0 |
| 585 | 1.5 | 4.0 | 585 | 1.5 | .3 |
| 613 | 1.4 | 0 | 613 | 1.2 | 0 |

(1)Flush cycle - 1 hour throughout test
(2)All hypochlorite and color measurements are on the basis of toilet bowl water concentrations.

The table clearly illustrates a dramatic increase in the color strength of the toilet bowl solution at approximately the level where the disinfectant would be expected to be exhausted. That level coincides with a significant decrease in the chlorine concentration. Accordingly, the calculated amounts of material for simultaneous exhaustion of a dual dispenser were approximately correct.

It is understood that the forms of the invention illustrated herein are preferred embodiments and that various modifications can be made without departing from the spirit of the invention.

What is claimed is:

1. A chemical dispenser adapted to dispense a predetermined volume of a chemical solution into a body of liquid in which said dispenser is immersed in response to the level of said body of liquid being lowered from a first elevation to a second elevation, said dispenser comprising:

(a) a container capable of holding both a quantity of a chemical in solid form and a chemical solution formed therefrom;

(b) an air vent in fluid communication with the upper portion of said container, said air vent extending upwardly and terminating above the top of said container; and (c) a siphon in fluid communication with said container for conveying a volume of said chemical solution from said container into said body of liquid in which said dispenser is immersed, said siphon commencing at an entry port in said container which is located below the top of said container and extending upwardly therefrom to a point above the top of said container but below the top of said air vent and thereafter turning in a downward direction as a result of an inverted U-shaped bend therein to terminate at a point below said entry port in said container, whereby said siphon delivers a volume of chemical solution to said body of liquid in response to the level of said body of liquid being lowered from a first elevation to a second elevation and delivers a substantially equal volume of liquid from said body of liquid through said siphon to said container when said body of liquid is raised from said second elevation to said first elevation.

2. The dispenser of claim 1, wherein said entry port is located in a shoulder located below the top of said container, and the volume of liquid dispensed or added to said container in response to the movement of said body of liquid between said first elevation and said second elevation is equal to the volume of said container which is disposed above said shoulder.

3. The dispenser of claim 1, wherein said entry port is disposed in a manner which enhances the degree of mixing between the solution contained in said container and the liquid entering said container through said entry port.

4. The dispenser of claim 3, wherein said entry port directs the fluid flowing through said siphon towards said solid chemical in said container.

5. The dispenser of claim 1, wherein said entry port is disposed in a manner which minimizes the degree of mixing between the solution contained in said container and the liquid entering said container through said entry port.

6. The dispenser of claim 5, wherein said entry port directs the fluid flowing through said siphon in a direction substantially parallel to said solid chemical in said container.

7. The dispenser of claim 1, wherein the size and shape of said siphon is selected so as to ensure a full flow of said chemical solution or said liquid in said siphon in response to changes in the level of said body of liquid without the formation of air bubbles therein which would interfere with the normal functioning of said siphon.

8. The dispenser of claim 7, wherein said siphon is a pipe having a width in the range of about $\frac{1}{8}$ to about $\frac{1}{4}$ inches.

9. The dispenser of claim 8, wherein said siphon is a thermoformed pipe and has a height of about $\frac{1}{8}$ to about 3/16 inches and a junction radius of 0 to about $\frac{1}{8}$ inches.

10. The dispenser of claim 7, wherein said siphon terminates at a point substantially level with the bottom of said container.

11. The dispenser of claim 7, wherein said siphon terminates at a point below the bottom of said container.

12. The dispenser of claim 1, wherein said air vent comprises a substantially straight pipe.

13. The dispenser of claim 12, wherein the upper end of said air vent terminates in a bend.

14. The dispenser of claim 4, wherein the solid chemical in said container is located below said entry port.

15. The dispenser of claim 14, wherein said solid chemical is a mixture comprising a surfactant and a colorant.

16. The dispenser of claim 14, wherein said colorant is a Direct Blue 86 dye.

17. The dispenser of claim 15, wherein said chemical solution has a characteristic color throughout the useful life of said dispenser.

18. The dispenser of claim 17, wherein said characteristic color changes after a period of use of said dispenser, said change in color signaling the substantial depletion of the solid chemicals in said dispenser.

19. The dispenser of claim 4, wherein the solid chemical in said container is a disinfectant compound.

20. the dispenser of claim 19, wherein said disinfectant compound is a material which provides hyprochlorite ion in aqueous solution.

21. A thermoformed chemical dispenser adapted to dispense a predetermined volume of a chemical solution into a body of liquid in which said dispenser is immersed in response to the level of said body of liquid being lowered from a first elevation to a second elevation, said dispenser comprising:

(a) a thermoformed container capable of holding both a quantity of a chemical in solid form and a chemical solution formed therefrom;

(b) a thermoformed air vent in fluid communication with the upper portion of said container, said air vent extending upwardly and terminating above the top of said container; and (c) a thermoformed siphon in fluid communication with said container for conveying a volume of said chemical solution from said container into said body of liquid in which said dispenser is immersed, said siphon commencing at an entry port in said container which is located in a shoulder located below the top of said container and extending upwardly therefrom to a point above the top of said container but below the top of said air vent and thereafter turning in a downward direction as a result of an inverted U-shaped bend therein to terminate at a point below said entry port in said container, said siphon being a thermoformed pipe having a width in the range of about $\frac{1}{8}$ to about $\frac{1}{4}$ inches, a height of about $\frac{1}{8}$ to about 3/16 inches and a junction radius of 0 to about $\frac{1}{8}$ inches, whereby said siphon delivers a full flow of a volume of chemical solution to said body of liquid in response to the level of said body of liquid being lowered from a first elevation to a second elevation and delivers a full flow of a substantially equal volume of liquid from said body of liquid through said siphon to said container when said body of liquid is raised from said second elevation to said first elevation without the formation of air bubbles which would interfere with the normal functioning of said siphon.

* * * * *